US008531341B2

(12) United States Patent
Schlub et al.

(10) Patent No.: US 8,531,341 B2
(45) **Date of Patent: *Sep. 10, 2013**

(54) ANTENNA ISOLATION FOR PORTABLE ELECTRONIC DEVICES

(75) Inventors: Robert W. Schlub, Santa Clara, CA (US); Robert J. Hill, Salinas, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/418,655

(22) Filed: Mar. 13, 2012

(65) Prior Publication Data

US 2012/0169550 A1 Jul. 5, 2012

Related U.S. Application Data

(63) Continuation of application No. 13/073,872, filed on Mar. 28, 2011, now Pat. No. 8,144,063, which is a continuation of application No. 11/969,684, filed on Jan. 4, 2008, now Pat. No. 7,916,089.

(51) Int. Cl.
*H01Q 1/24* (2006.01)

(52) U.S. Cl.
USPC ..... 343/702

(58) Field of Classification Search
USPC ..... 343/702, 700 MS, 833–835
See application file for complete search history.

(56) References Cited

U.S. PATENT DOCUMENTS

| | | | | |
|---|---|---|---|---|
| 4,509,056 | A | 4/1985 | Ploussios | |
| 5,463,406 | A | 10/1995 | Vannatta et al. | |
| 5,784,032 | A | 7/1998 | Johnston et al. | |
| 5,917,458 | A | 6/1999 | Ho et al. | |
| 6,040,803 | A * | 3/2000 | Spall | 343/700 MS |
| 6,184,845 | B1 | 2/2001 | Leisten et al. | |
| 6,414,643 | B2 | 7/2002 | Cheng et al. | |
| 6,456,249 | B1 | 9/2002 | Johnson | |

(Continued)

FOREIGN PATENT DOCUMENTS

| | | |
|---|---|---|
| CN | 1706070 | 12/2005 |
| CN | 1875522 | 12/2006 |

(Continued)

OTHER PUBLICATIONS

Guterman et al., U.S. Appl. No. 12/888,350, filed Sep. 22, 2010.

(Continued)

*Primary Examiner* — Huedung Mancuso
(74) *Attorney, Agent, or Firm* — Treyz Law Group; G. Victor Treyz; David C. Kellogg

(57) ABSTRACT

Portable electronic devices are provided with wireless circuitry that includes antennas and antenna isolation elements. The antennas may include antennas that have multiple arms and that are configured to handle communications in multiple frequency bands. The antennas may also include one or more antennas that are configured to handle communications in a single frequency band. The antennas may be coupled to different radio-frequency transceivers. For example, there may be first, second, and third antennas and first and second transceivers. The first and third antennas may be coupled to the first transceiver and the second antenna may be coupled to the second transceiver. The antenna isolation elements may be interposed between the antennas and may serve to reduce radio-frequency interference between the antennas. There may be a first antenna isolation element between the first and second antennas and a second antenna isolation element between the second and third antennas.

19 Claims, 16 Drawing Sheets

(56) References Cited

U.S. PATENT DOCUMENTS

| | | | | |
|---|---|---|---|---|
| 6,486,836 | B1 | 11/2002 | Hill | |
| 6,552,692 | B1 | 4/2003 | Zeilinger et al. | |
| 6,556,812 | B1 * | 4/2003 | Pennanen et al. | 343/702 |
| 6,570,538 | B2 | 5/2003 | Vaisanen et al. | |
| 6,614,400 | B2 | 9/2003 | Egorov | |
| 6,624,789 | B1 | 9/2003 | Kangasvieri et al. | |
| 6,639,558 | B2 | 10/2003 | Kellerman et al. | |
| 6,795,021 | B2 | 9/2004 | Ngai et al. | |
| 6,987,485 | B2 | 1/2006 | Ito et al. | |
| 7,053,850 | B1 | 5/2006 | Bogdans et al. | |
| 7,068,229 | B2 | 6/2006 | Lin | |
| 7,403,160 | B2 | 7/2008 | Chiang et al. | |
| 7,405,702 | B2 | 7/2008 | Annamaa et al. | |
| 7,525,504 | B1 | 4/2009 | Song et al. | |
| 7,592,969 | B2 | 9/2009 | Proctor et al. | |
| 7,595,759 | B2 | 9/2009 | Schlub et al. | |
| 7,639,190 | B2 | 12/2009 | Shimasaki et al. | |
| 7,688,273 | B2 | 3/2010 | Montgomery et al. | |
| 7,696,943 | B2 | 4/2010 | Chiang | |
| 7,768,461 | B2 | 8/2010 | Cheng et al. | |
| 7,768,462 | B2 | 8/2010 | Zhang et al. | |
| 7,804,458 | B2 | 9/2010 | Montgomery et al. | |
| 7,864,123 | B2 * | 1/2011 | Hill et al. | 343/702 |
| 8,350,761 | B2 * | 1/2013 | Hill et al. | 343/702 |
| 2004/0056712 | A1 | 3/2004 | Lee et al. | |
| 2004/0070548 | A1 | 4/2004 | Cake | |
| 2005/0041624 | A1 | 2/2005 | Hui et al. | |
| 2006/0038736 | A1 | 2/2006 | Hui et al. | |
| 2006/0238437 | A1 | 10/2006 | Huang | |
| 2007/0069958 | A1 | 3/2007 | Ozkar | |
| 2008/0106478 | A1 | 5/2008 | Hill | |
| 2008/0143611 | A1 | 6/2008 | Wang | |
| 2008/0258992 | A1 | 10/2008 | Tsai | |
| 2008/0316121 | A1 | 12/2008 | Hobson et al. | |
| 2009/0174612 | A1 | 7/2009 | Ayala et al. | |
| 2009/0275370 | A1 | 11/2009 | Schlub et al. | |
| 2010/0073241 | A1 | 3/2010 | Vazquez et al. | |
| 2010/0073242 | A1 | 3/2010 | Vazquez et al. | |
| 2010/0073243 | A1 | 3/2010 | Vazquez et al. | |
| 2010/0080151 | A1 | 4/2010 | Proctor et al. | |
| 2010/0156741 | A1 | 6/2010 | Vazquez et al. | |
| 2012/0169550 | A1 | 7/2012 | Schlub et al. | |

FOREIGN PATENT DOCUMENTS

| | | |
|---|---|---|
| CN | 101036262 | 9/2007 |
| EP | 1083622 | 3/2001 |
| JP | 2004 023369 | 1/2004 |
| WO | 2006018711 | 12/2006 |

OTHER PUBLICATIONS

Kough et al., U.S. Appl. No. 12/490,286, filed Jun. 23, 2009.
Zhu et al., U.S. Appl. No. 13/464,789, filed May 4, 2012.

* cited by examiner

ANTENNA ISOLATION FOR PORTABLE ELECTRONIC DEVICES

This application is a continuation of patent application Ser. No. 13/073,872, filed Mar. 28, 2011, now U.S. Pat. No. 8,144,063 which is a continuation of patent application Ser. No. 11/969,684, filed Jan. 4, 2008, now U.S. Pat. No. 7,916,089, which are hereby incorporated by referenced herein in their entireties. This application claims the benefit of and claims priority to patent application Ser. No. 13/073,872, filed Mar. 28, 2011 and patent application Ser. No. 11/969,684, filed Jan. 4, 2008, now U.S. Pat. No. 7,916,089.

BACKGROUND

This invention relates generally to wireless communications circuitry, and more particularly, to wireless communications circuitry with antenna isolation for electronic devices such as portable electronic devices.

Handheld electronic devices and other portable electronic devices are becoming increasingly popular. Examples of handheld devices include handheld computers, cellular telephones, media players, and hybrid devices that include the functionality of multiple devices of this type. Popular portable electronic devices that are somewhat larger than traditional handheld electronic devices include laptop computers and tablet computers.

Due in part to their mobile nature, portable electronic devices are often provided with wireless communications capabilities. For example, handheld electronic devices may use long-range wireless communications to communicate with wireless base stations. Cellular telephones and other devices with cellular capabilities may communicate using cellular telephone bands at 850 MHz, 900 MHz, 1800 MHz, and 1900 MHz. Portable electronic devices may also use short-range wireless communications links. For example, portable electronic devices may communicate using the Wi-Fi® (IEEE 802.11) band at 2.4 GHz and the Bluetooth® band at 2.4 GHz. Communications are also possible in data service bands such as the 3G data communications band at 2170 MHz band (commonly referred to as UMTS or Universal Mobile Telecommunications System band).

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Antennas such as planar inverted-F antennas (PIFAs) and antennas based on L-shaped resonating elements can be fabricated in this way. Antennas such as PIFA antennas and antennas with L-shaped resonating elements can be used in handheld devices.

Although modern portable electronic devices often use multiple antennas, it is challenging to produce successful antenna arrangements in which multiple antennas operate in close proximity to each other without experiencing undesirable interference.

It would therefore be desirable to be able to provide improved antenna structures for wireless electronic devices.

SUMMARY

A portable electronic device such as a handheld electronic device is provided with wireless communications circuitry that includes antennas and antenna isolation elements. The antenna isolation elements may be interposed between respective antennas to reduce radio-frequency interference between the antennas and thereby improve antenna isolation.

With one suitable arrangement, there are at least three antennas in the wireless communications circuitry. The three antennas may each have a respective antenna resonating element. The antenna resonating elements may be formed from conductive structures such as traces on a flex circuit or stamped metal foil structures (as examples). Each antenna resonating element may have at least one antenna resonating element arm. The arms may be aligned along a common axis.

The antenna isolation elements may be formed from antenna isolation resonating elements such as L-shaped strips of conductor. The L-shaped conductive strips may have arms that are aligned with the common axis.

The antennas and the antenna isolation elements may share a common ground plane. With this type of configuration, a first antenna resonating element and the ground plane form a first antenna, a second antenna resonating element and the ground plane form a second antenna, a third antenna resonating element and a ground plane form a third antenna, a first antenna isolation resonating element and the ground plane form a first antenna isolation element, and a second antenna isolation resonating element and the ground plane form a second antenna isolation element.

If desired, some of the antennas and resonating elements may have multiple arms. For example, the first and third antenna resonating elements may have arms that are aligned with the common axis and arms that are perpendicular to the common axis.

The first and third antennas may be used to implement an antenna diversity scheme. With one suitable arrangement, a Wi-Fi transceiver that operates at 2.4 GHz and 5.1 GHz is coupled to the first and third antennas, whereas a Bluetooth transceiver that operates at 2.4 GHz is coupled to the second antenna. Antenna isolation elements that operate at 2.4 GHz may be placed between the first and second antennas and between the second and third antennas, thereby isolating the first antenna from the third antenna at 2.4 GHz and isolating the first and third antennas from the second antenna at 2.4 GHz.

Further features of the invention, its nature and various advantages will be more apparent from the accompanying drawings and the following detailed description of the preferred embodiments.

DETAILED DESCRIPTION

The present invention relates generally to wireless communications, and more particularly, to wireless electronic devices and antennas for wireless electronic devices.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices are handheld electronic devices.

The wireless electronic devices may be, for example, cellular telephones, media players with wireless communications capabilities, handheld computers (also sometimes called personal digital assistants), remote controllers, global positioning system (GPS) devices, and handheld gaming devices. The wireless electronic devices may also be hybrid devices that combine the functionality of multiple conventional devices. Examples of hybrid portable electronic devices include a cellular telephone that includes media player functionality, a gaming device that includes a wireless communications capability, a cellular telephone that includes game and email functions, and a portable device that receives email, supports mobile telephone calls, has music player functionality and supports web browsing. These are merely illustrative examples.

Figure 1:
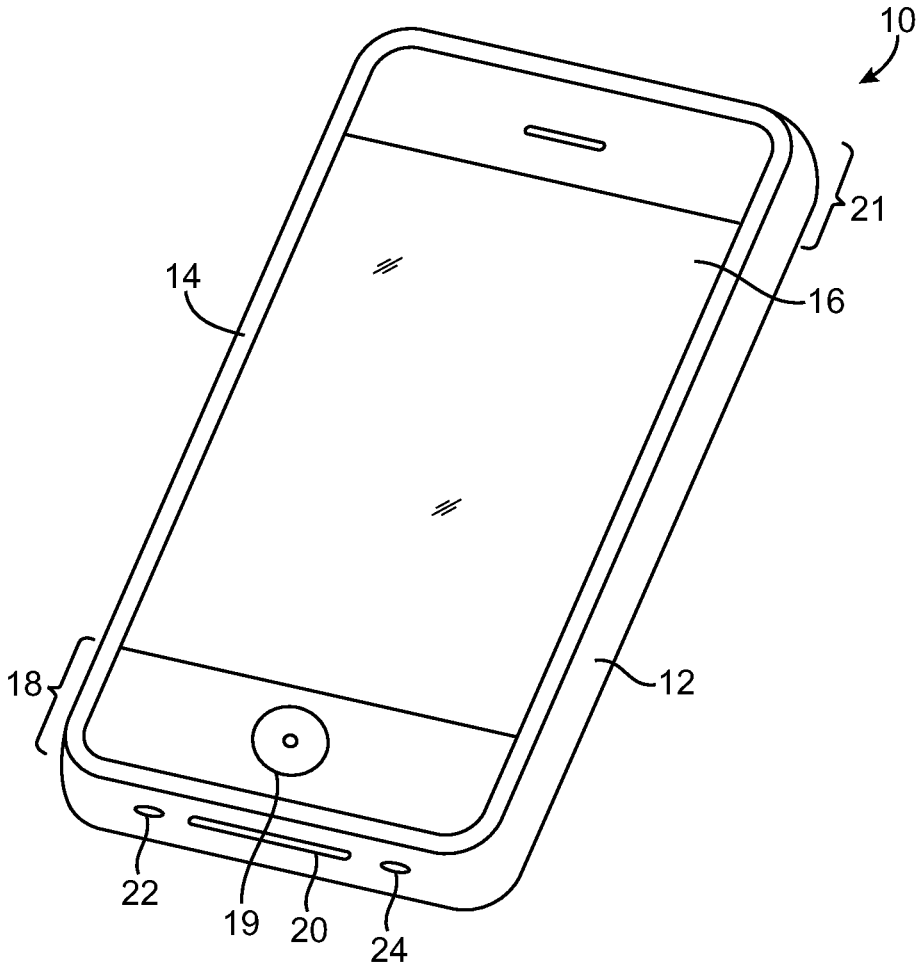
FIG. 1 is a perspective view of an illustrative electronic device with isolated antenna structures in accordance with an embodiment of the present invention.

An illustrative portable electronic device in accordance with an embodiment of the present invention is shown in FIG. 1. Device 10 of FIG. 1 may be, for example, a handheld electronic device.

Device 10 may have housing 12. Antennas for handling wireless communications may be housed within housing 12 (as an example).

Housing 12, which is sometimes referred to as a case, may be formed of any suitable materials including, plastic, glass, ceramics, metal, or other suitable materials, or a combination of these materials. In some situations, housing 12 or portions of housing 12 may be formed from a dielectric or other low-conductivity material, so that the operation of conductive antenna elements that are located in proximity to housing 12 is not disrupted. Housing 12 or portions of housing 12 may also be formed from conductive materials such as metal. An illustrative housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antennas in device 10. For example, metal portions of housing 12 may be shorted to an internal ground plane in device 10 to create a larger ground plane element for that device 10. To facilitate electrical contact between an anodized aluminum housing and other metal components in device 10, portions of the anodized surface layer of the anodized aluminum housing may be selectively removed during the manufacturing process (e.g., by laser etching).

Housing 12 may have a bezel 14. The bezel 14 may be formed from a conductive material and may serve to hold a display or other device with a planar surface in place on device 10. As shown in FIG. 1, for example, bezel 14 may be used to hold display 16 in place by attaching display 16 to housing 12.

Display 16 may be a liquid crystal diode (LCD) display, an organic light emitting diode (OLED) display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

Display screen 16 (e.g., a touch screen) is merely one example of an input-output device that may be used with electronic device 10. If desired, electronic device 10 may have other input-output devices. For example, electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 24 and 22 may, if desired, form microphone and speaker ports. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of electronic device 10 may supply input commands using user input interface devices such as button 19 and touch screen 16. Suitable user input interface devices for electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown schematically as being formed on the top face of electronic device 10 in the example of FIG. 1, buttons such as button 19 and other user input interface devices may generally be formed on any suitable portion of electronic device 10. For example, a button such as button 19 or other user interface control may be formed on the side of electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Electronic device 10 may have ports such as port 20. Port 20, which may sometimes be referred to as a dock connector, 30-pin data port connector, input-output port, or bus connector, may be used as an input-output port (e.g., when connecting device 10 to a mating dock connected to a computer or other electronic device). Device 10 may also have audio and video jacks that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, a subscriber identity module (SIM) card port to authorize cellular telephone service, a memory card slot, etc. The functions of some or all of these devices and the internal circuitry of electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of electronic device 10 to function properly without being disrupted by the electronic components.

Examples of locations in which antenna structures may be located in device 10 include region 18 and region 21. These are merely illustrative examples. Any suitable portion of device 10 may be used to house antenna structures for device 10 if desired.

Figure 2:
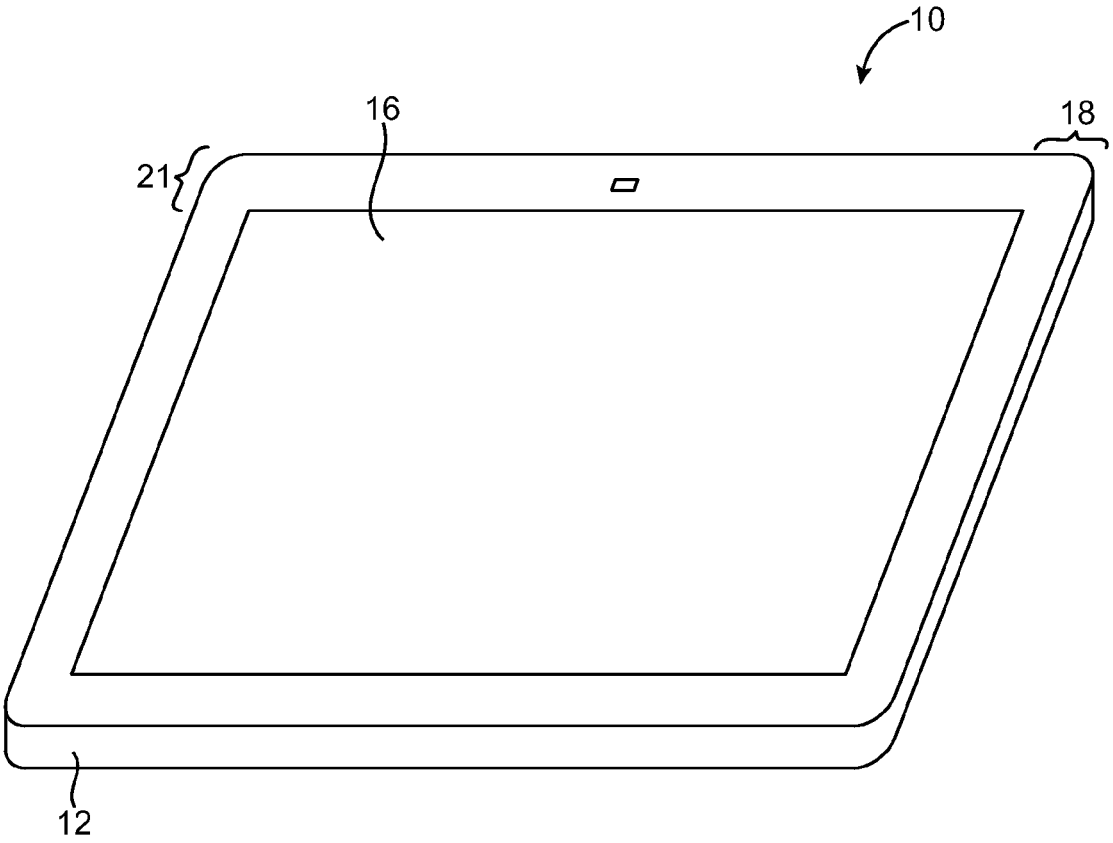
FIG. 2 is a perspective view of another illustrative electronic device with isolated antenna structures in accordance with an embodiment of the present invention.

If desired, electronic device 10 may be a portable electronic device such as a laptop or other portable computer. For example, electronic device 10 may be an ultraportable computer, a tablet computer, or other suitable portable computing device. An illustrative portable electronic device 10 of this type is shown in FIG. 2. As shown in FIG. 2, such portable electronic devices may have a screen 16 on a housing 12. Antennas may be placed at any suitable location within device 10. For example, antenna structures may be located along the right-hand edge of housing 12 (e.g., in region 18 of FIG. 2) or may be located along the upper edge of housing 12 (e.g., in region 21 of FIG. 2). These are merely illustrative examples. If desired, antenna structures may be placed along a left-hand edge, a bottom edge, or in portions of housing 12 other than a housing edge (e.g., in the middle of housing 12 or on an extendable structure that is connected to device 10). An advantage of locating antenna structures along a device edge is that this generally allows the antennas to be placed in a location that is separated somewhat from conductive structures that might otherwise impede the operation of the antenna structures.

Figure 3:
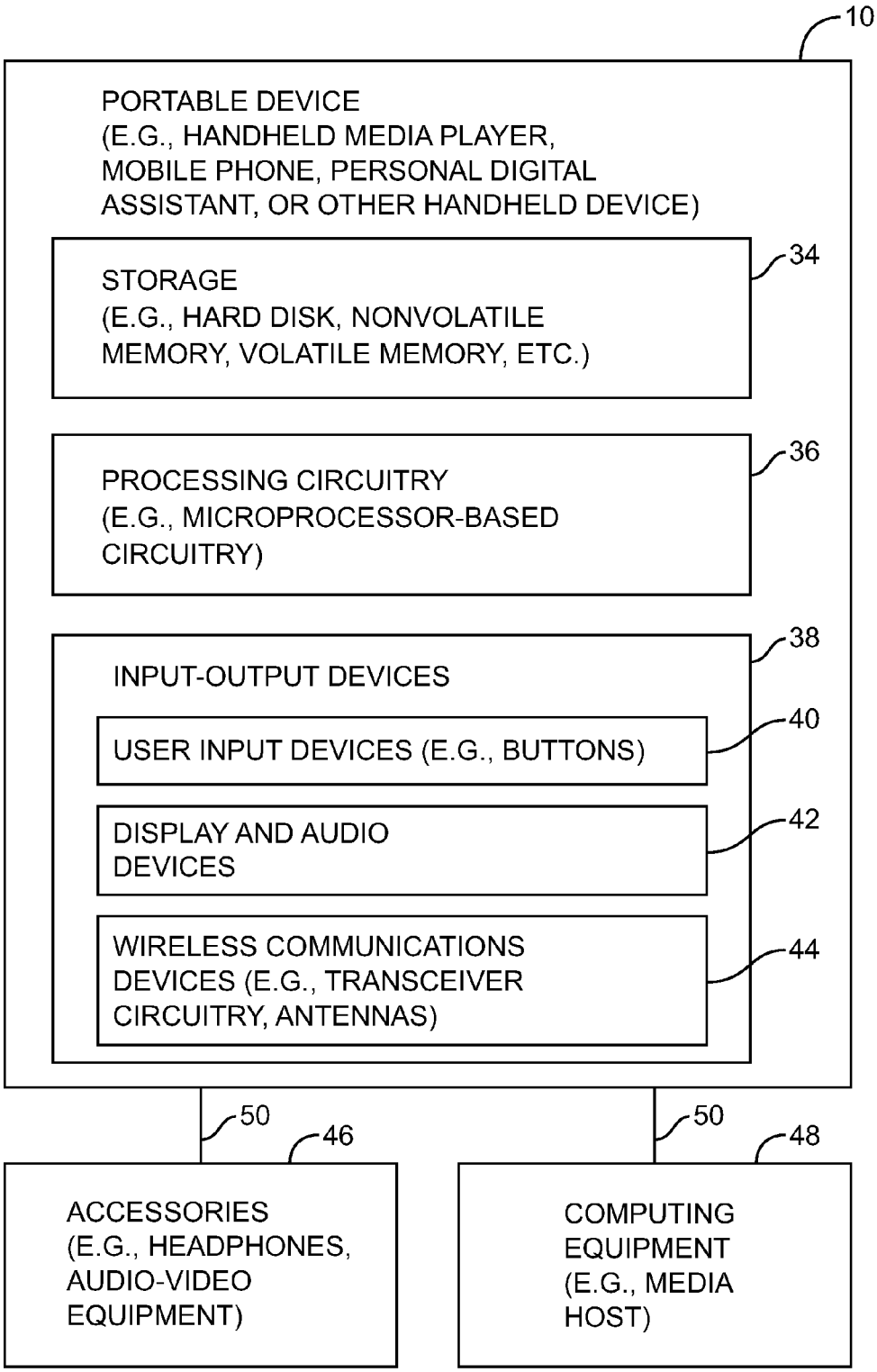
FIG. 3 is a schematic diagram of an illustrative portable electronic device with isolated antenna structures in accordance with an embodiment of the present invention.

A schematic diagram of an embodiment of an illustrative portable electronic device is shown in FIG. 3. Portable device 10 may be a mobile telephone, a mobile telephone with media player capabilities, a handheld computer, a remote control, a game player, a global positioning system (GPS) device, a laptop computer, a tablet computer, an ultraportable computer, a combination of such devices, or any other suitable portable electronic device.

As shown in FIG. 3, device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, cellular telephone communications protocols, etc.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another portable electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1550 MHz. The 850 MHz band is sometimes referred to as the Global System for Mobile (GSM) communications band. The 900 MHz communications band is sometimes referred to as the Extended GSM (EGSM) band. The 1800 MHz band is sometimes referred to as the Digital Cellular System (DCS) band. The 1900 MHz band is sometimes referred to as the Personal Communications Service (PCS) band.

Device 10 can cover these communications bands and/or other suitable communications bands with proper configuration of the antenna structures in wireless communications circuitry 44.

With one suitable arrangement, which is sometimes described herein as an example, the wireless communications circuitry of device 10 may have at least two antennas that are used in a diversity arrangement to handle communications in a first communications band. Antenna diversity arrangements use multiple antennas in parallel to obtain improved immunity to proximity effects and improved throughput. The antennas may operate in any suitable frequency band. For example, the antennas may be used to handle local area network (LAN) communications in a communications band that is centered at 2.4 GHz (e.g., the 2.4 GHz IEEE 802.11 frequency band sometimes referred to as Wi-Fi®). If desired, antenna diversity arrangements may be implemented using more than two antennas (e.g., three or more antennas). For clarity, examples with two antennas are sometimes described herein as an example.

At least one additional antenna may be placed in close proximity to the diversity scheme antennas. The additional antenna may, for example, be placed in the vicinity of the other antennas to conserve space in electronic device 10. For example, the additional antenna may be placed between the other antennas. With one suitable arrangement, the antennas have resonating element structures with longitudinal axis that are all aligned.

The additional antenna may operate at the same frequency as the other antennas. For example, the additional antenna may operate at 2.4 GHz (e.g., to handle Bluetooth® communications). Because the antennas operate in the same communications band, care should be taken to avoid undesirable interference between the antennas.

The amount of isolation that is required between the antennas depends on the particular requirements of the system in which the antennas are being used. For example, the designers of portable electronic device 10 may require that the two diversity scheme antennas exhibit greater than 25 dB of isolation from each other and may require that the additional antenna exhibit greater than 15 dB of isolation relative to the other two antennas. These isolation criteria may be applied to antenna structures that exhibit a three-dimensional antenna efficiency of about 25-50%.

To achieve these levels of isolation, antenna isolation elements may be provided in the vicinity of the antennas. The structures that make up the antenna isolation elements may, for example, be interposed between the antenna resonating elements of the antennas. The antennas and the antenna isolation elements may share a common ground plane.

Figure 4:
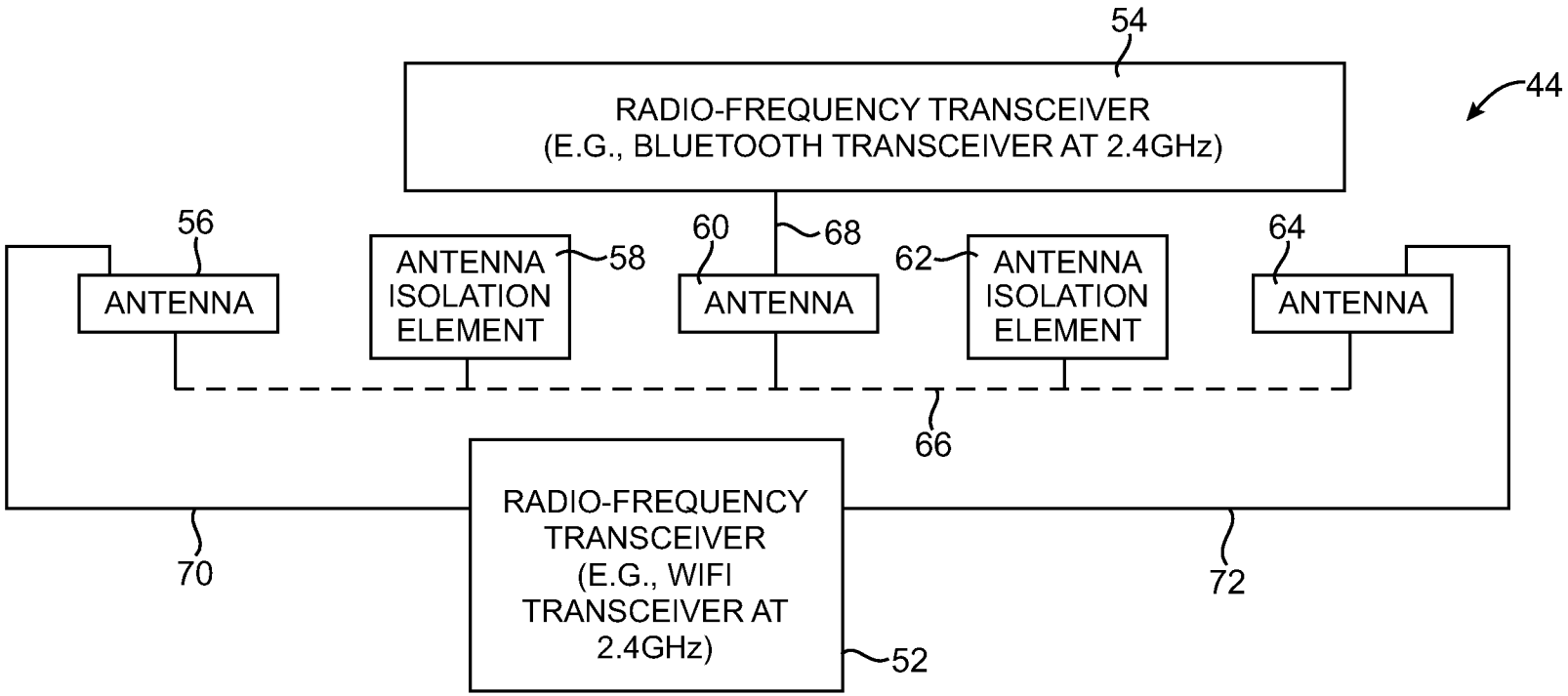
FIG. 4 is a schematic diagram of illustrative portable electronic device isolated antenna structures in accordance with an embodiment of the present invention.

An illustrative antenna arrangement of this type is shown in FIG. 4. As shown in FIG. 4, wireless communications circuitry 44 may include first and second radio-frequency transceivers such as radio-frequency transceiver 52 and radio-frequency transceiver 54 (sometimes referred to as "radios"). Transceiver 54 may be, for example, a Bluetooth transceiver that is connected to antenna 60 by transmission line 68. Transceiver 52 may be, for example, a Wi-Fi transceiver that is connected to antennas 56 and 64 by transmission lines 70 and 72. Transmission lines 68, 70, and 72 may be any transmission lines suitable for carrying radio-frequency signals between radio-frequency transceivers and antennas. For example, transmission lines 68, 70, and 72 may be coaxial cable transmission lines, microstrip transmission lines, etc.

Transceiver 52 or other circuitry in device 10 may monitor the status of antennas 56 and 64 to implement an antenna diversity scheme. With this type of arrangement, transceiver 52 may use both antennas simultaneously or may opt to use primarily or exclusively antenna 56 or antenna 64 depending on which antenna has a higher associated signal strength or is less affected by proximity effects (e.g., from the close proximity of a user's hand or other part of a user's body), etc. Transceiver 52 may include coupling circuitry that routes radio-frequency signals to antenna 56 and/or antenna 64 from a transmitter in transceiver 52 during radio-frequency transmissions and that routes radio-frequency signals from antenna 56 and/or antenna 64 to a receiver in transceiver 52 during reception of radio-frequency signals. Transceiver 54 may include radio-frequency transmitter circuitry for transmitting radio-frequency signals and may include receiver circuitry for receiving radio-frequency signals.

During operation of device 10, it may be desirable to use transceiver 54 and transceiver 52 at the same time. The ability to operate transceivers 54 and 52 asynchronously may allow, for example, a user to use a Bluetooth headset to use device 10 to make a voice-over-internet-protocol (VOIP) telephone call. Transceiver 54 may be used to establish a wireless Bluetooth link with the Bluetooth headset. At the same time, transceiver 52 may be used to establish an IEEE 802.11(n) Wi-Fi link with a wireless access point connected to the Internet. Because both links may be used simultaneously, both links may carry data traffic without interruption.

The IEEE 802.11(n) protocol is an example of a protocol that may use antenna diversity to improve performance. This type of arrangement uses two antennas (e.g., antennas 56 and 64) to carry Wi-Fi traffic. In general, any suitable number of antennas such as antennas 56 and 64 may be used in an antenna diversity scheme. For example, there may be three or more antennas coupled to transceiver 52. The use of an arrangement with two diversity antennas is described herein as an example. Moreover, the Bluetooth link or other communications link that is established between transceiver 54 and antenna 60 is merely illustrative. There may be more than one antenna 60 and there may be more than one associated transceiver 54 that is coupled to that antenna if desired.

As shown in FIG. 4, antennas 56, 60, and 64 may share a common ground plane (e.g., ground plane 66). With this type of arrangement, each of antennas 56, 60, and 64 may have an associated antenna resonating element. These antenna resonating elements may be formed using inverted-F structures, planar inverted-F structures, L-shaped monopole structures, or any other suitable antenna resonating element configuration. The antenna resonating element portions of antennas 56, 60, and 64 are generally spaced somewhat above common ground 66. Common ground 66 may be formed from conductive elements in device 10 such as housing 12, printed circuit boards, conductive packages for integrated circuits in device 10, conductive components that are electrically connected to printed circuit boards or other grounded elements, etc. In a typical arrangement, some or all of these grounded structures are substantially planar. Accordingly, common ground structure 66 is sometimes referred to as a ground plane and is sometimes depicted schematically as an ideal plane. In practice, however, some non-planar structures may protrude slightly from portions of the ground plane. To ensure good efficiency for antennas 56, 60, and 64, sufficient clearance may be provided between such protruding conductive structures and the antenna resonating elements of antennas 56, 60, and 64.

Antenna 60 is generally located between antennas 56 and 64, as shown in FIG. 4. If there were an unlimited amount of space in device 10, it might be possible to place antenna 60 at a remote location, thereby ensuring adequate isolation between antenna 60 and antennas 56 and 64 based on physical separation. In real-world configurations for device 10, this type of layout may not be practical. Accordingly, antenna 60 may be located between antennas 56 and 64. This may provide a compact layout arrangement that fits within the potentially tight confines of housing 12.

Because the printed circuit board and other conductive elements of ground plane 66 are electrically connected to form a common ground plane structure for antennas 56, 60, and 64, it may not be possible to create electrical gaps in ground plane 66 to help isolate antennas 56, 60, and 64 from each other. Particularly in situations such as these, it may be advantageous to use antenna isolation elements. As shown in FIG. 4, for example, radio-frequency isolation between antennas 56, 60, and 64 may be enhanced using antenna isolation elements 58 and 62. Antenna isolation elements 58 and 62 may be formed from antenna resonating element structures that are similar to the antenna resonating element structures used in antennas 56, 60, and 64. For example, antenna isolation elements 58 and 62 may be formed using inverted-F structures, planar inverted-F structures, L-shaped structures, etc. Unlike antennas 56, 60, and 64, however, the antenna isolation elements 58 do not have antenna feed terminals that are coupled to transmission lines such as transmission lines 68 and 70. Rather, antenna isolation elements 58 and 62 serve to provide enhanced levels of radio-frequency isolation between antennas 56, 60, and 64. In effect, isolation elements 58 and 62 may serve as radio-frequency chokes that prevent undesirable near-field electromagnetic coupling between antennas 56, 60, and 64 at the frequency of interest (e.g., in the common communications frequency band of 2.4 GHz in this example).

For example, with antenna isolation elements 58 and 62 in place, antennas 56 and 64 may exhibit greater than 25 dB of isolation from each other, whereas antenna 60 may exhibit greater than 15 dB of isolation relative to antennas 58 and 64. These isolation specifications may be achieved for antennas 56, 60, and 64 that exhibit three-dimensional antenna efficiencies of about 25-50% (as an example). Moreover, these isolation specification (or other suitable specifications) may be achieved when operating all antennas 56, 60, and 64 in the same frequency band (e.g., at 2.4 GHz or other suitable resonant frequency).

To enhance the capabilities of antennas 56, 60, and 64, some or all of antennas 56, 60, and 64 may operate in multiple communications bands. For example, antennas 56 and 64 may be configured to handle communications at both 2.4 Hz and 5.1 GHz (e.g., to handle additional Wi-Fi bands). In this type of configuration, radio-frequency transceiver (or an associated transceiver) may be used to convey signals at 5.1 GHz to and from antennas 56 and 64 over communications paths such as transmission lines 70 and 72 in addition to the 2.4 GHz signals that are being conveyed between the antennas and transceiver 52. Antenna 60 may be a single band antenna or may be a multiband antenna.

In a typical configuration, the resonating element structures of antennas 56, 60, and 64 and of antenna isolation elements 58 and 62 may have lateral dimensions on the order of a quarter of a wavelength at each frequency of interest (e.g., on the order of a couple of centimeters for 2.4 GHz communications). Antennas 56 and 64 may be separated by about 14 centimeters (as an example). Antenna 60 may be located midway between antennas 56 and 64. With one suitable arrangement, antennas 56, 60, and 64 and antenna isolation elements 58 and 62 are arranged in a line (i.e., along a common axis that is aligned with the longitudinal axis of each of the resonating elements in antennas 56, 60, and 64 and antenna isolation elements 58 and 62). Collinear arrangements such as these are illustrative. Other configurations (e.g., with different antenna resonating element sizes and/or different spacings and relative positions for the antennas) may be used if desired.

Figure 5:
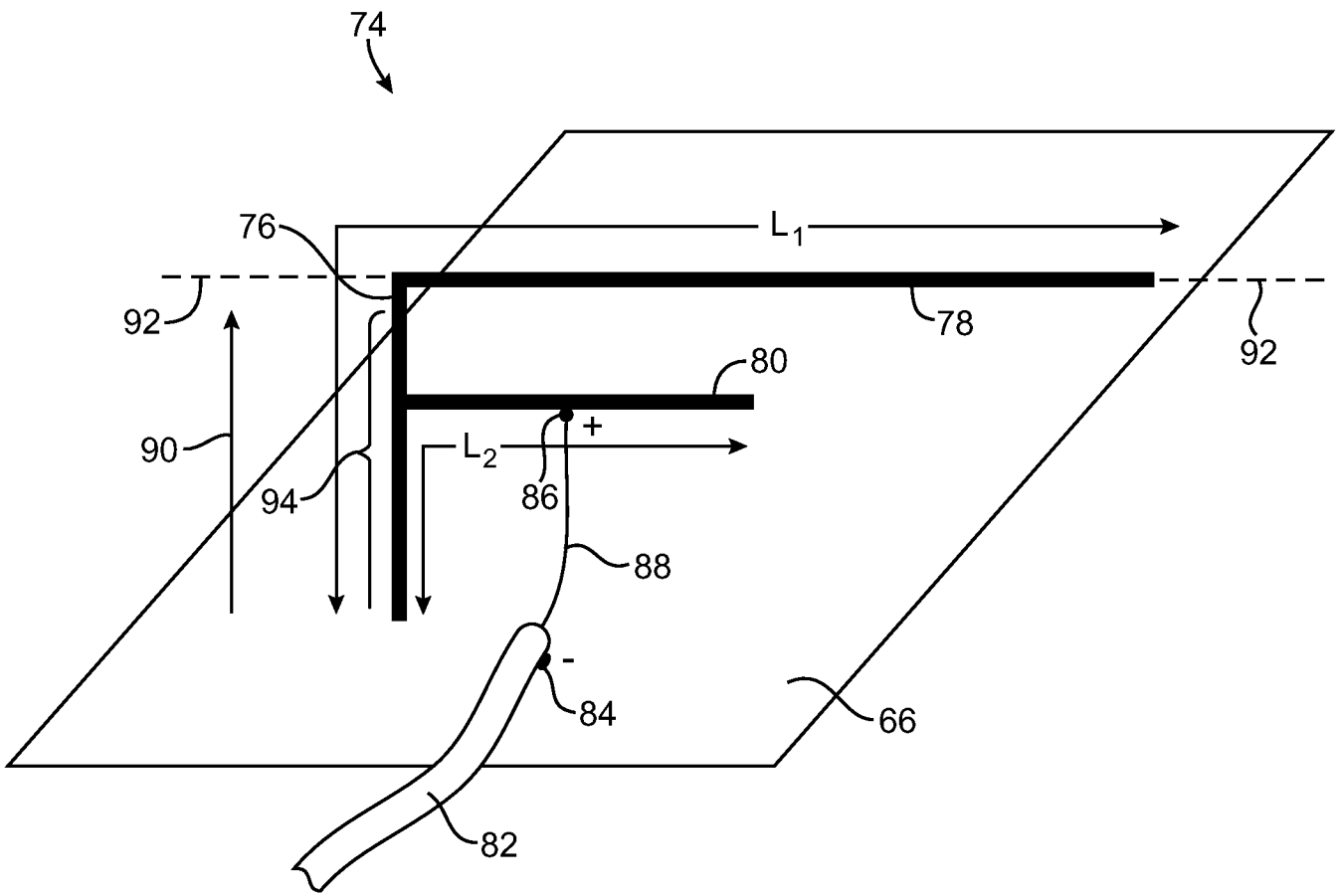
FIG. 5 is a perspective view of an illustrative electronic device antenna in accordance with an embodiment of the present invention.

An illustrative configuration for an antenna such as antenna 56 or 64 is shown in FIG. 5. This type of configuration may also be used for antenna 60 (e.g., when antenna 60 is a dual-band antenna).

As shown in FIG. 5, antenna 74 may have an antenna resonating element 76 and ground plane portion 66. Together, antenna resonating element 76 and ground plane 66 make up the two poles in antenna 74. Ground plane 66 is preferably shared by other antennas in device 10 as shown in FIG. 4. These other antennas are not shown in FIG. 5 to avoid overcomplicating the drawing.

Antenna resonating element 76, ground plane 66 and the other antenna structures in device 10 (including the resonating element structures associated with isolation elements 58 and 62) may be formed from any suitable conductive materials (e.g., copper, gold, metal alloys, other conductors, or combinations of such conductive materials). Such structures may be formed from stamped foils, from screen-printed structures, from conductive traces formed on flexible printed circuit substrates (so-called flex circuits) or using any other suitable arrangement.

In the example of FIG. 5, antenna resonating element 76 has multiple branches formed by first arm 78 and second arm 80. These branches each form a resonant structure with a different effective length. A longer length L1 is associated with longer arm 78 of antenna resonating element 76. A shorter length L2 is associated with shorter arm 80 of antenna resonating element 76. The length L1 may be equal to about a quarter of a wavelength at a first operating frequency. The length L2 may be equal to about a quarter of a wavelength at a second operating frequency. For example, the length L1 may be equal to a quarter of a wavelength at 2.4 GHz and the length L2 may be equal to a quarter of a wavelength at 5.1 GHz. As shown in FIG. 5, resonating element 76 may include a vertical portion 94 that extends parallel to vertical axis 90. Vertical axis 90 is perpendicular to ground plane 66. Resonating element 76 also generally includes horizontal portions such as arms 78 and 80 in the FIG. 5 example.

The horizontal portions of antenna resonating element 76 run parallel to ground plane 66. Antenna 74 of FIG. 5 has a longitudinal axis 92 that is defined by the main portions of antenna resonating element 76 (e.g., by arm 78 in the example of FIG. 5). Arms such as arm 78 and arm 80 may run parallel to longitudinal axis 92. With one suitable arrangement, antennas 56, 60, and 64 and antenna isolation elements 58 and 62 are substantially collinear with axis 92 and each other.

If desired, some or all of the antennas and isolation elements can be located off of axis 92 (e.g., by a small offset amount such as by a few millimeters or by a relatively larger distance such as centimeter or more), but in general, such off-axis locations may not be highly favored because locating isolation elements 58 and 62 off of the longitudinal axis that runs through antennas 56, 60, and 64 will generally tend to reduce the effectiveness of isolation elements 58 and 62 in isolating the antennas from each other. Locating antennas 56, 60, and 64 at off-axis positions also tends to increase the overall footprint for the antennas, which makes it more difficult to fit the desired antenna structures into a device with a compact form factor.

The antennas in device 10 may be fed directly using feed terminals that are connected to portions of the antenna or indirectly through near-field coupling arrangements. In the illustrative example of FIG. 5, antenna 74 is fed using positive antenna feed terminal 86 and negative (ground) antenna feed terminal 84. A transmission line such as coaxial cable 82 may be used to convey signals to and from feed terminals 86 and 84. Transmission line center conductor 88 may be used to convey signals to and from positive antenna feed terminal 86. The outer ground conductor of transmission line 82 is connected to terminal 84. The outer ground conductor of transmission line 82 to terminal 84. The antenna feed arrangement of FIG. 5 is merely illustrative. Any suitable feed arrangement may be used. For example, antenna feed terminals 86 and 84 may be located at other portions of antenna 74 (e.g., so that the positive terminal is coupled to long arm 78 or so that the horizontal position of the feed point is adjusted for impedance matching). Moreover, a tuning network (e.g., a circuit formed from capacitors, inductors, etc.) may be coupled to antenna 74 or may be used as part of a feed network.

Figure 6:
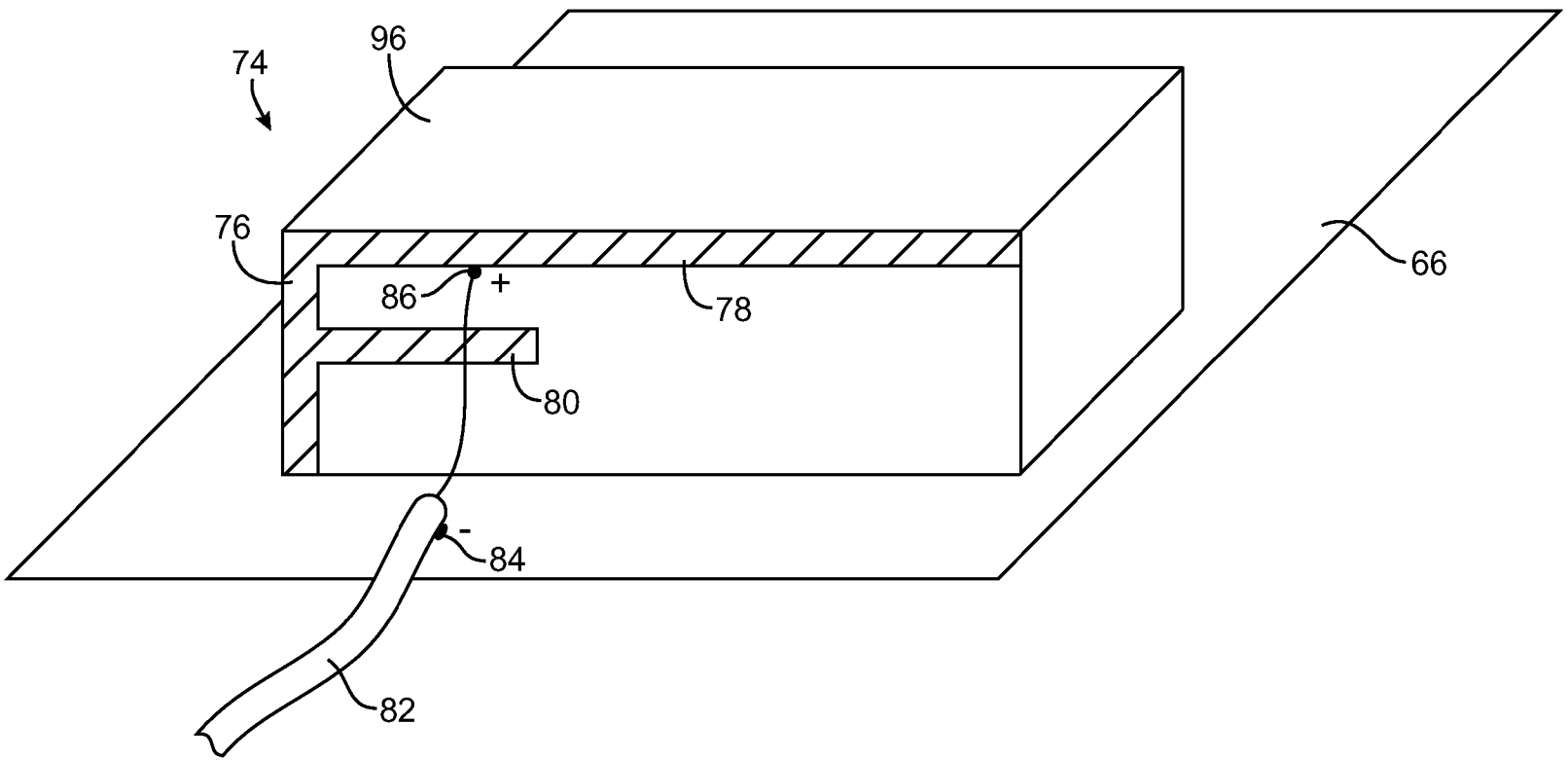
FIG. 6 is a perspective view of an illustrative portable electronic device antenna that has been mounted on a support structure and that is being fed by a transmission line in accordance with an embodiment of the present invention.

The antennas and isolation elements of device 10 may have dielectric support structures. An example of this type of arrangement is shown in FIG. 6. As shown in FIG. 6, antenna 74 may have an antenna resonating element such as element 76 that is supported by a dielectric support structure such as dielectric support structure 96. Resonating element 76 may be formed from conductive traces on a flex circuit substrate or other suitable conductive materials. Dielectric support structure 96 may be formed from plastic or other suitable dielectric materials. In the example of FIG. 6, antenna 74 is being fed using a positive feed terminal 86 that is connected to antenna resonating element arm 78. Antenna ground terminal 84 is connected to ground plane 66. Arrangements of the type shown in FIG. 6 may be used for antennas 56 and 64 (e.g., when antennas 56 and 64 are dual-band antennas). Arrangements of the type shown in FIG. 6 may also be used for antenna 60 (e.g., when antenna 60 is a dual-band antenna). If one of arms 78 and 80 is omitted, antenna resonating element 76 will have an L-shape configuration. In this type of configuration, resonating element 76 may be used for a single-band antenna 60. When feed terminals 86 and 84 are omitted, single-arm or multi-arm resonating elements such as element 76 of FIG. 6 may serve as antenna isolation elements 58 and 62.

Figure 7:
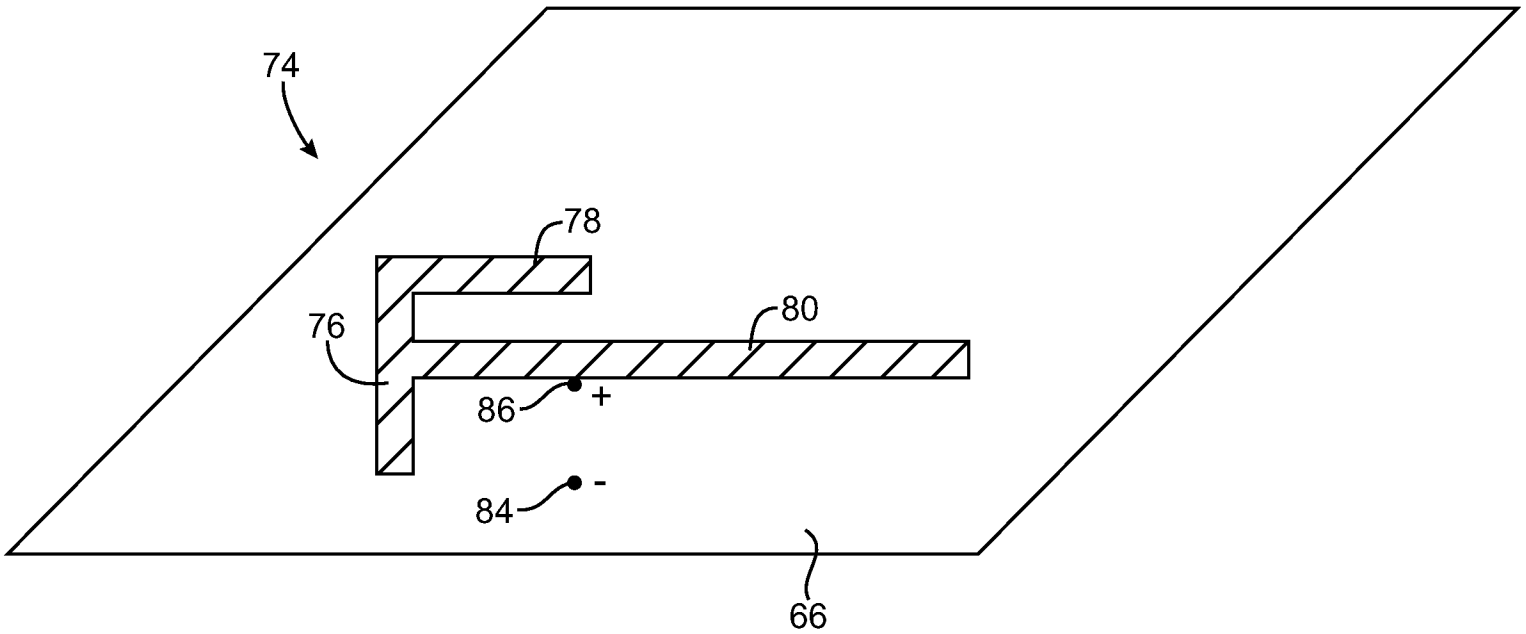
FIG. 7 is a perspective view of an illustrative portable electronic device antenna having a ground plane and first and second antenna resonating element arms including a longer arm that is located nearer to the ground plane than a shorter arm in accordance with an embodiment of the present invention.

As shown in FIG. 7, it is not necessary for the longer arm of a resonating element (in either an antenna or an antenna isolation element) to be located farther from the ground plane than the shorter arm of the resonating element. In the FIG. 7 example, shorter resonating element arm 78 in resonating element 76 is located farther from ground plane 66 than longer resonating element arm 80.

Antenna feed terminals for antennas such as antenna 74 of FIG. 7 may be placed at any suitable location. For example, positive antenna feed terminal 86 may be connected to arm 80 and ground antenna feed terminal 84 may be connected to ground conductor 66.

Figure 8:
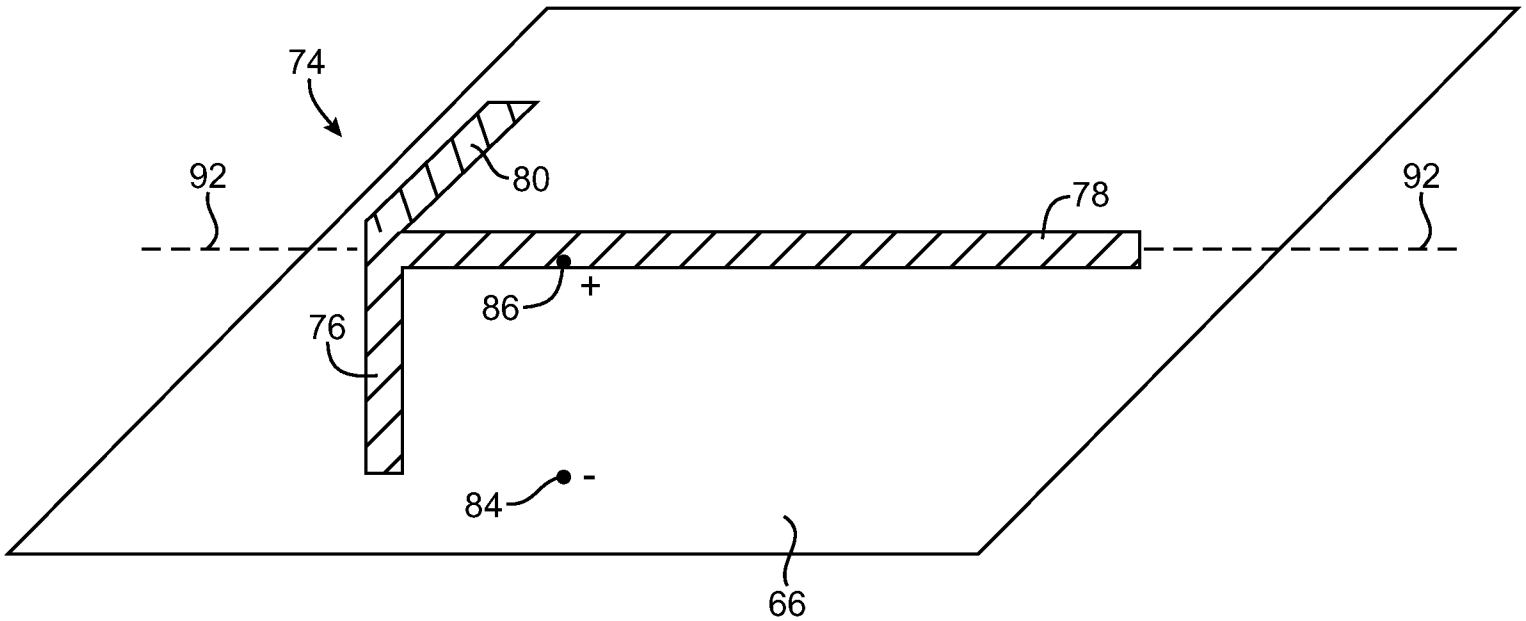
FIG. 8 is a perspective view of an illustrative portable electronic device antenna having short and long arms that are oriented so that they are orthogonal to each other while lying in a plane parallel to a ground plane in accordance with an embodiment of the present invention.

The bandwidth of an antenna such as the antenna of FIG. 7 is in part determined by the vertical position of its arms. Antennas with antenna resonating element arms that are located relatively farther from ground plane 66 tend to exhibit relatively more bandwidth than antennas with resonating element structures that are located near to ground plane 66. An illustrative antenna resonating element configuration in which both antenna resonating element arms are located at substantially the same vertical distance from ground plane 66 (and which therefore both produce antenna resonances with maximum bandwidth) is shown in FIG. 8. As shown in FIG. 8, antenna 74 may have a longer arm such as long arm 78 that is aligned with longitudinal axis 92 and a shorter arm such as short arm 80 that lies perpendicular to arm 78. Both arm 78 and arm 80 lie parallel to ground plane 66.

Particularly in situations in which it is desirable to provide the higher-frequency band of a multi-band antenna with a maximized bandwidth (e.g., when handling the 5.1 GHz band of a 2.4 GHz/5.1 GHz dual-band Wi-Fi antenna), it may be advantageous to use an arrangement of the type shown in FIG. 8 or FIG. 7, because these configurations for antenna resonating element 76 place shorter antenna resonating element arm 80 at a relatively large vertical position relative to ground plane 66 than would otherwise be possible. An advantage of the FIG. 8 arrangement is that the enhanced vertical spacing associated with arm 80 is achieved without adversely affecting the vertical spacing associated with arm 78.

Figure 9:
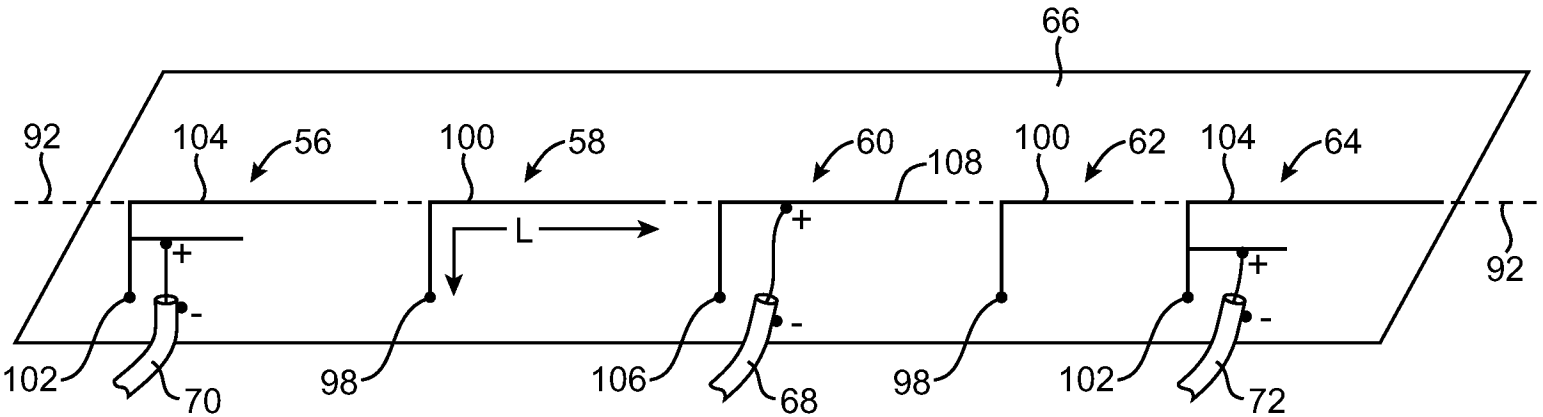
FIG. 9 is a perspective view of an illustrative portable electronic device antenna structure having three antennas isolated by two antenna isolation structures in accordance with an embodiment of the present invention.

A perspective view of an illustrative antenna configuration of the type that is shown schematically in FIG. 4 is shown in FIG. 9. As shown in FIG. 9, antennas 56, 60, and 64 may be arranged in a line on common ground plane 66 (i.e., aligned in a collinear fashion with axis 92). Each antenna may have a longitudinal axis defined by its longest arm. Each such longitudinal axis may, if desired, be aligned with axis 92 as shown in FIG. 9. Similarly, isolation elements 58 and 62 may be configured so that they each have a longitudinal axis that is aligned with axis 92. Antennas 56 and 64 may be dual-band antennas each having two respective resonating element arms. Antenna 60 may be a single band antenna (as an example). Antenna 60 may be formed from an L-shaped resonating element, as shown in FIG. 9. Antenna isolation elements 58 and 62 may be formed from any suitable antenna resonating element structures. For example, antenna isolation elements 58 and 62 may be formed from L-shaped resonating elements, as shown in FIG. 9.

To ensure that isolation elements 58 and 62 provide satisfactory radio-frequency isolation for antennas 56, 60, and 64, the resonating element structures that make up antenna isolation elements 58 and 62 may be tuned to resonate at the frequency at which isolation is desired. For example, if antennas 56 and 64 resonate at 2.4 GHz and 5.1 GHz and antenna 60 resonates at 2.4 GHz, and if isolation is desired at 2.4 GHz, antenna isolation elements 58 and 62 may have L-shaped resonating elements of length L, where L is equal to a quarter of a wavelength at 2.4 GHz.

As shown in FIG. 9, the antenna isolation elements may have termination points such as termination points 98. L-shaped conductive elements such as elements 100 may have lengths L that are selected to provide isolation between antennas 56 and 64 and between antenna 60 and antennas 56 and 64. Antennas 56 and 64 may have antenna resonating elements 104 that are connected to ground plane 66 at points 102. Antenna 60 may have an antenna resonating element such as resonating element 108 that is connected to ground plane 66 at point 106.

In the example of FIG. 9, resonating elements 104 and 108 of antennas 56, 60, and 64 extend upwards and to the right (in the orientation shown in FIG. 9). Similarly, antenna isolation elements 58 and 62 have resonating elements 100 that extend upwards and to the right from points 98. This configuration is merely illustrative. Antennas 56, 60, and 64 and antenna isolation elements 58 and 62 may extend upwards and to the left and/or upwards and to the right in any suitable combination (e.g., all facing to the right, all facing to the left, the antennas facing to the right and the isolation elements facing to the left, the antennas facing to the left and the isolation elements facing to the right, some of the antennas facing to the right and some to the left, some of the isolation elements facing to the right and some to the left, or combinations of these arrangements).

Figure 10:
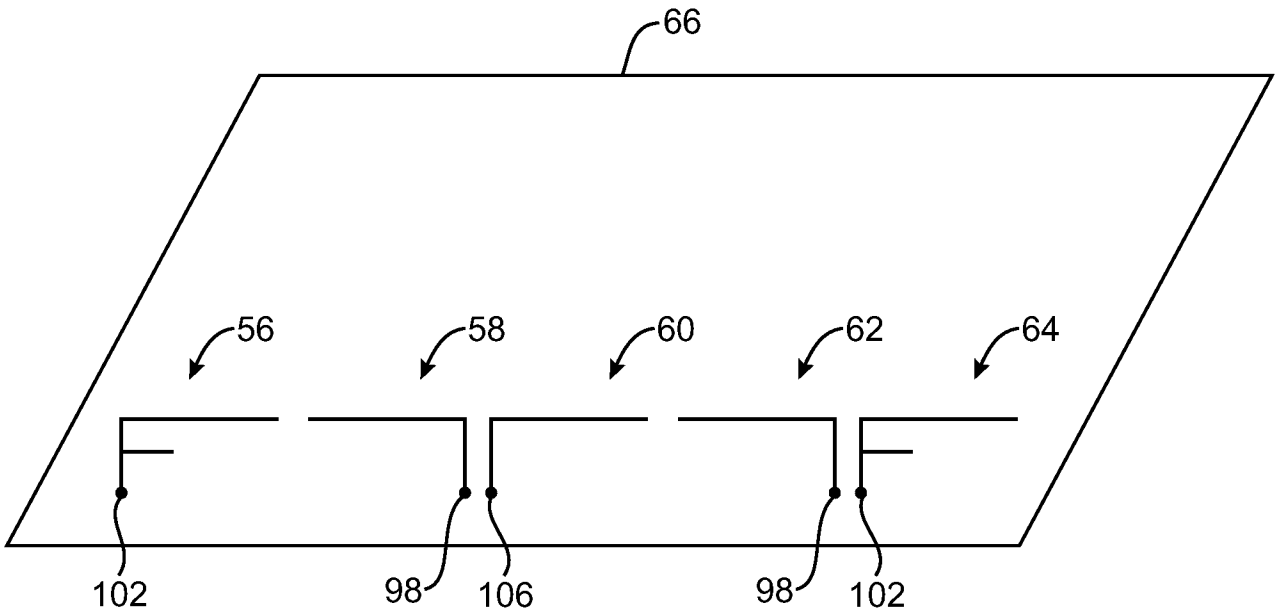
FIG. 10 is a perspective view of a portable electronic device antenna structure in which antennas are isolated by isolation elements that extend in a vertical direction that is perpendicular to a ground plane in accordance with the present invention.

FIG. 10 shows an illustrative antenna configuration in which antennas 56, 60, and 64 have resonating elements that extend upwards and to the right (i.e., elements that face to the right) and in which isolation elements 58 and 62 face to the left. In this type of configuration, points 98 are located in the vicinity of points 106 and 102.

Figure 11:
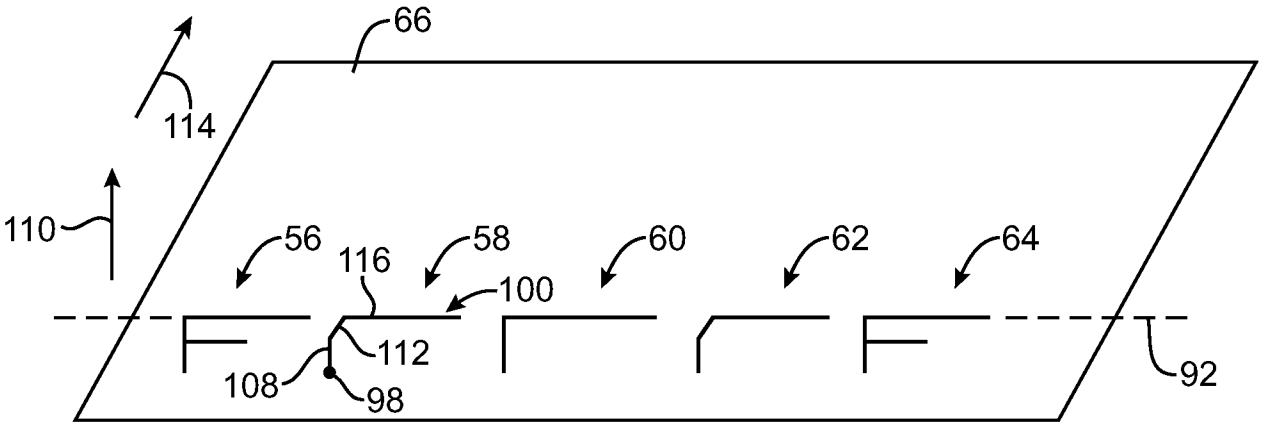
FIG. 11 is a perspective view of a portable electronic device antenna structure with antennas and antenna isolation elements in which the antenna isolation elements each have a bent portion that runs perpendicular to the longitudinal axis of the antennas in accordance with an embodiment of the present invention.

An alternative configuration for the antennas of device 10 is shown in FIG. 11. In the arrangement of FIG. 11, antenna isolation elements 58 and 62 have resonating elements with perpendicular conductive portions such as portion 112 of element 58. Resonating element 100 is connected to ground conductive structure 66 at point 98. Vertical portion 108 extends vertically in vertical direction 110, perpendicular to the plane of ground conductor 66. Horizontal perpendicular section 112 extends in direction 114. Direction 114 is parallel to ground plane 66 and is perpendicular to vertical direction 110 and longitudinal axis 92. Horizontal portion 116 of resonating element 100 extends parallel to longitudinal axis 92, perpendicular to horizontal direction 114, and perpendicular to vertical direction 110. If desired, antennas 56, 60, and 64 may have bends (e.g., perpendicular sections such as perpendicular portion 112 and/or U-shaped portions or serpentine paths). Isolation elements 58 and 62 may also have bends of different shapes and orientations. The arrangement of FIG. 11 is merely illustrative.

Figure 12:
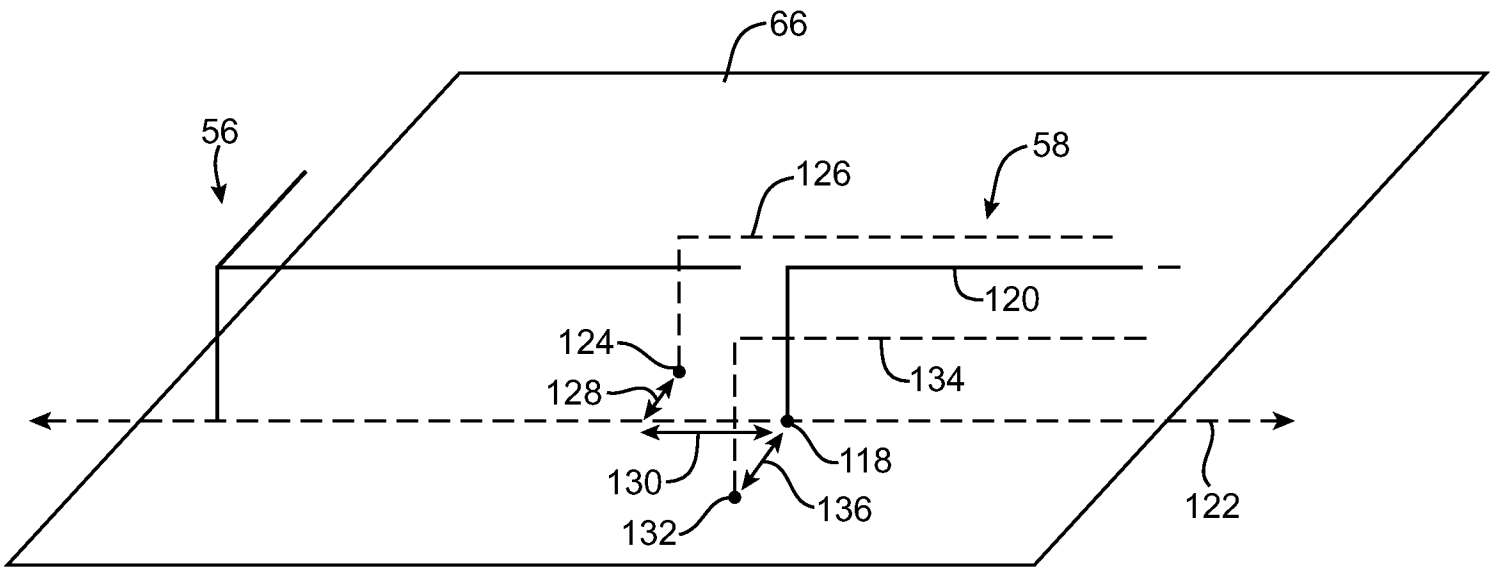
FIG. 12 is a perspective view of an illustrative portable electronic device antenna resonating element and an associated antenna isolation element showing possible locations for the associated antenna isolation element relative to the portable electronic device antenna resonating element in accordance with an embodiment of the present invention.

If desired, the antenna isolation elements may be located at positions that are offset somewhat from axis 92. FIG. 12 shows potential offset positions in which isolation element 58 may be placed relative to antenna 56.

Isolation element 58 may be located so that it contacts ground plane 66 at point 118. In this type of situation, the resonant element of isolation element 58 will be positioned where indicated by solid line 120. As indicated by dashed line 122, in this configuration, the resonating element of antenna 56 is collinear with the resonating element of antenna isolation element 58. Because point 118 lies on line 122, there is no lateral offset between the location of resonating element 58 and the longitudinal axis of the antennas in device 10 (e.g., antenna 56 and the antennas that are not shown in FIG. 12).

If desired, isolation element 58 may be located so that it contacts ground plane 66 at point 132. In this configuration, antenna isolation element 58 will be positioned where indicated by dashed line 134. Contact point 132 is offset from dashed line 122 by lateral offset distance 136. Provided that lateral offset 136 is not too large, antenna isolation element 58 may still provide sufficient isolation for the antennas of device 10. For example, a lateral offset of a fraction of a millimeter or a few millimeters may be acceptable for antennas that are a few centimeters in length.

Isolation element 58 may be provided with both a lateral and longitudinal offset with respect to antenna 56. This type of configuration is illustrated by dashed line 126. When the resonating element of antenna isolation element 58 is aligned with the position indicated by dashed line 126, the resonating element contacts ground plane 66 at point 124. As shown in FIG. 12, point 124 is laterally offset from dashed line 122 by lateral offset distance 128 and is longitudinally offset from point 118 (which is substantially vertically aligned with the tip of the longer resonating element arm of antenna 56) by longitudinal offset distance 130. Provided that the magnitudes of the longitudinal offset and lateral offset are not too large (e.g., several millimeters as an example), isolation element 58 may provide sufficient radio-frequency isolation for the antennas of device 10.

One isolation element, two isolation elements, or more than two isolation elements (e.g., in arrangements with four or more antennas) may be offset as shown in FIG. 12. If desired, mixed arrangements may be used (e.g., in which some isolation elements are laterally and/or longitudinally offset and in which some isolation elements are not offset). Moreover, antennas such as antennas 56, 60, and 64 may be longitudinally and/or laterally offset with respect to each other and with respect to the isolation elements.

Figure 13:
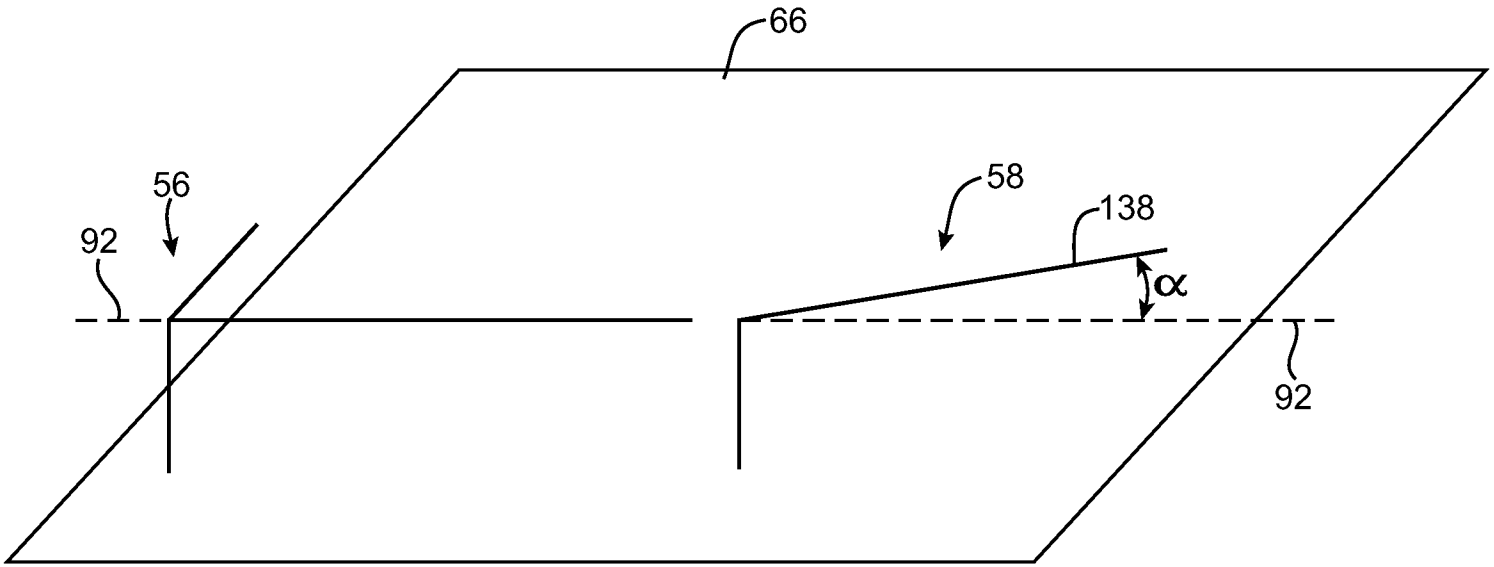
FIG. 13 is a perspective view of an illustrative portable electronic device antenna resonating element and an associated antenna isolation element showing possible angular orientations for the associated antenna isolation element relative to the longitudinal axis of the electronic device antenna resonating element in accordance with an embodiment of the present invention.

The arms of the antenna isolation elements and/or antennas in device 10 may also be oriented at non-zero angles with respect to longitudinal axis 92 if desired. An example of this type of arrangement is shown in FIG. 13. As shown in FIG. 13, antenna 56 has a longitudinal axis 92. The other antennas of device 10 (e.g., antennas 60 and 64) may be aligned with axis 92. Isolation elements such as isolation element 58 may be interposed between adjacent antennas to provide enhanced levels of radio-frequency signal isolation. Antenna isolation element 58 may have an L-shaped resonating element conductor. Arm 138 of the resonating element may be oriented at a non-zero angle α with respect to axis 92. Any suitable angle α may be used. For example, isolation element 58 may have a resonating element arm 138 that is oriented at an angle α of about 1-10° with respect to axis 92 (as an example).

Non-zero resonating element arm orientations of the type illustrated by the orientation of isolation element arm 138 of FIG. 13 may be used for antenna resonating elements and/or isolation element resonating elements. None of the elements, one or more of the elements, or all of the elements may be angled with respect to axis 92 if desired. Moreover, angled resonating element arrangements such as these may be used in configurations in which the resonating elements are longitudinally and/or laterally offset from axis 92.

Figure 14:
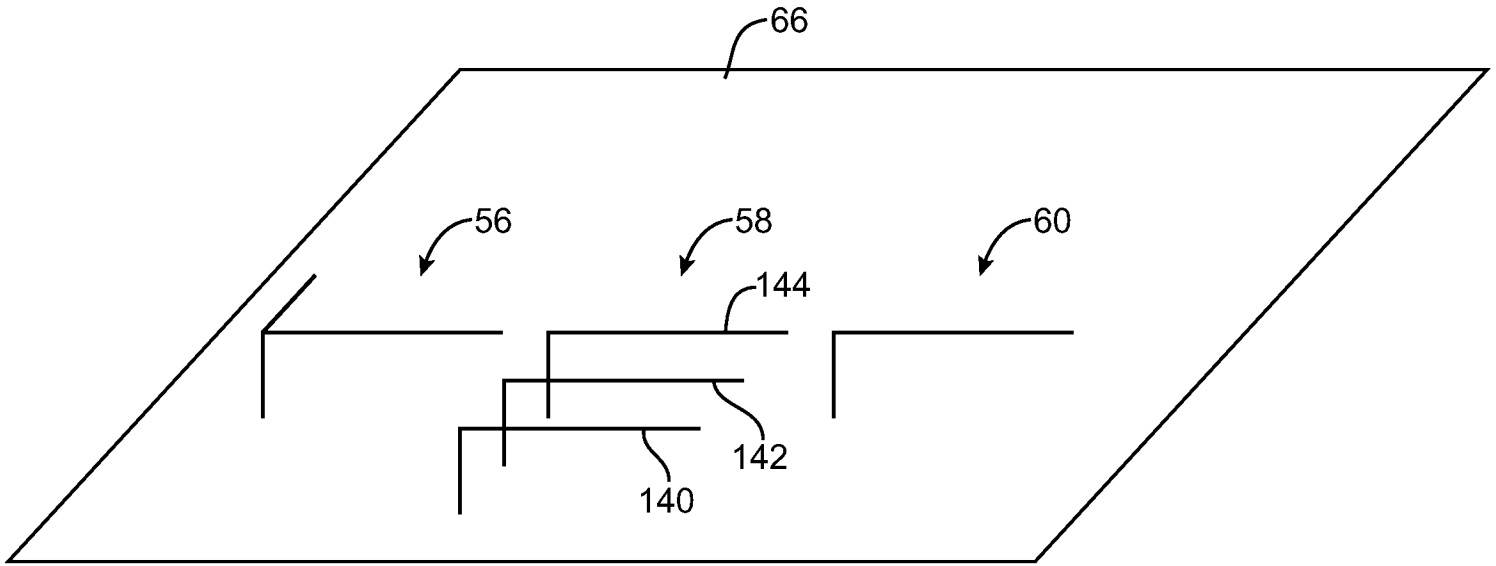
FIG. 14 is a perspective view of two illustrative portable electronic device antennas separated by an antenna isolation element having multiple antenna isolation element structures in accordance with an embodiment of the present invention.

If desired, one or more of the antenna isolation elements may be implemented using multiple resonating element structures. As shown in FIG. 14, for example, antenna isolation element 56 may be implemented using three L-shaped conductive resonating elements: resonating element 140, resonating element 142, and resonating element 144. Each of these conductive structures may be oriented at a zero angle with respect to longitudinal axis 92 of antennas 56 and 60 or at a non-zero angle with respect to longitudinal axis 92 of antennas 56 and 60 (as described in connection with FIG. 13). Lateral and longitudinal offsets may be used in positioning resonating elements 140, 142, and 144 as described in connection with FIG. 12. Moreover, different numbers of resonating element structures may be used. For example, antenna isolation element 58 may have more than three L-shaped conductive structures, or may have two L-shaped conductive structures.

The conductors of antenna isolation element 58 may have any suitable shape (e.g., L-shaped, multi-branched, shapes with bends, shapes with U-shaped and/or serpentine layouts, structures with combinations of these configurations, etc.). One of the antenna isolation elements may use multiple conductive structures, two of the antenna isolation elements may use multiple conductive structures, or (in arrangements using more than three antennas) three or more of the antenna isolation elements may use multiple conductive structures. The conductive structures in a given antenna isolation element may be substantially similar in shape or may have different shapes and sizes.

Figure 15:
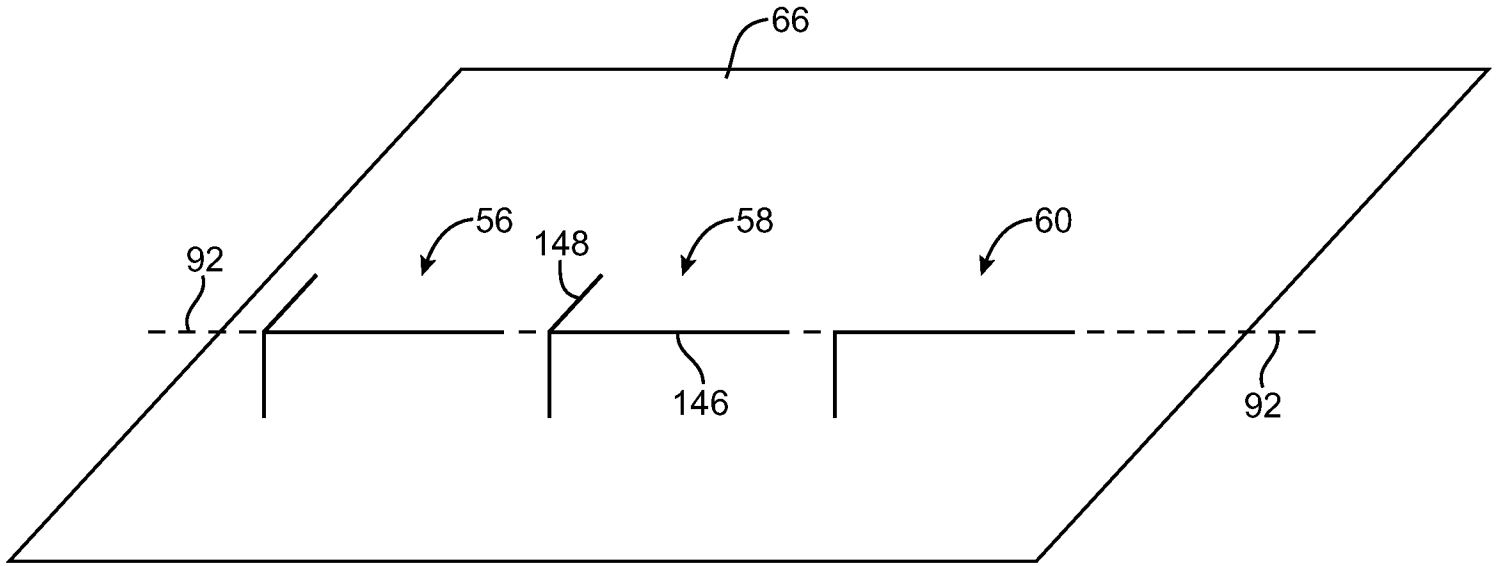
FIG. 15 is a perspective view of two illustrative portable electronic device antennas separated by an antenna isolation element having multiple orthogonal antenna isolation element arms in accordance with an embodiment of the present invention.

Antenna isolation elements 58 and 62 may be formed using multi-arm configurations. When the antenna isolation elements have multiple arms, the frequency response of the antenna isolation elements may be broadened to help enhance radio-frequency signal isolation effectiveness. An illustrative configuration in which antenna isolation element 58 is provided with multiple arms is shown in FIG. 15. As shown in FIG. 15, antenna isolation element 58 may have a first arm such as arm 146 and a second arm such as arm 148. Additional arms may be used if desired.

Arm 146 may be longer than arm 148 (as an example). Arm 146 may be oriented so that it is parallel to longitudinal axis 92 of antennas such as antennas 56 and 60. Arm 148 may be oriented perpendicular to axis 92 and parallel to ground plane 66.

Figure 16:
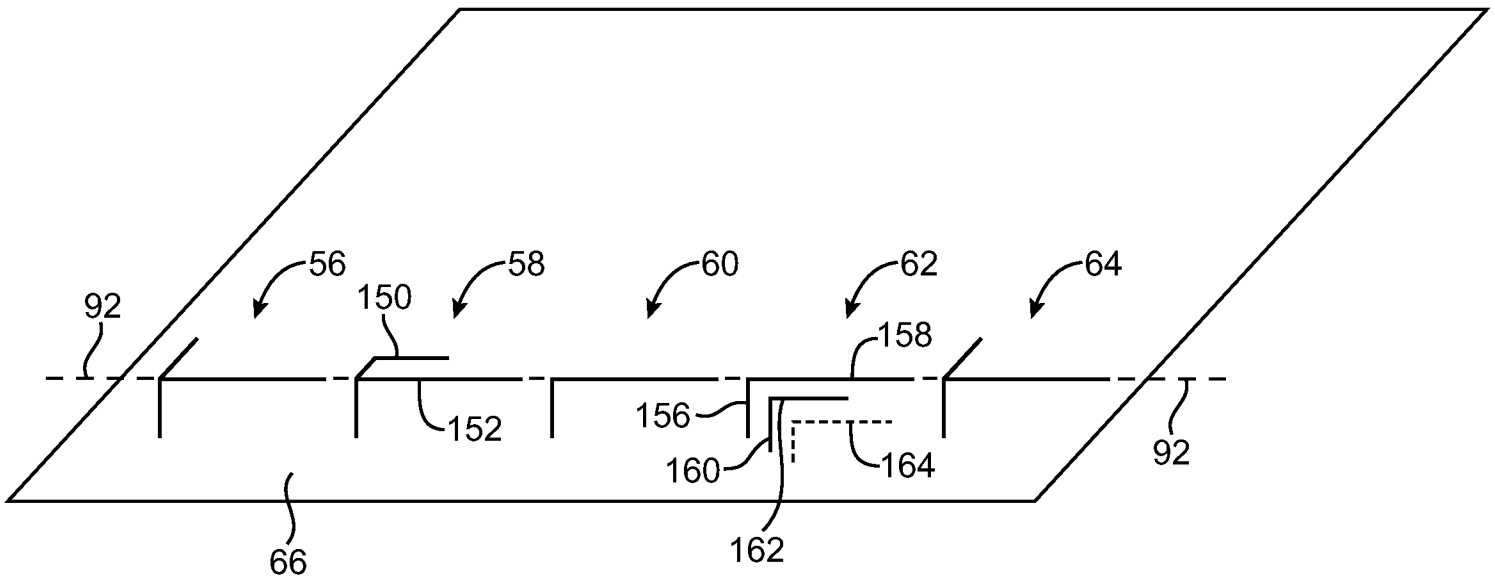
FIG. 16 is a perspective view of three illustrative portable electronic device antennas, two of which are isolated by an antenna isolation element having multiple parallel antenna isolation element arms and two of which are isolated by an antenna isolation element having two individual L-shaped isolation element structures in accordance with an embodiment of the present invention.

Additional suitable multi-arm configurations for the antenna isolation elements are shown in FIG. 16. In the example of FIG. 16, antenna isolation element 58 has two arms. Arm 152 is longer than arm 150. Both arm 150 and arm 152 lie parallel to axis 92 (which is aligned with the longitudinal axis of each antenna and isolation structure in the FIG. 16 arrangement). Antenna isolation element 62 is formed from multiple free-standing structures. One resonating element structure in antenna isolation element 62 is formed from L-shaped conductive strip 156. Another resonating element structure in antenna isolation element 62 is formed from smaller L-shaped conductive strip 160. As shown in FIG. 16, arm 158 of resonating element 156 may be larger than arm 162 of element 160. If desired, structures such as resonating element 160 may be laterally or longitudinally offset, so that their attachment points to ground plane 66 are shifted with respect to the position shown for element 160. For example, the position of a resonating element such as resonating element 160 may be longitudinally shifted so that it is aligned with the position indicated by dashed line 164.

In general, the antenna isolation elements may have one or more individual resonating element structures. The structures may have the same shapes and sizes or may have different shapes and sizes. The structures may have one arm (e.g., in an L-shaped conductive strip) or may have multiple arms. The structures may be aligned with the longitudinal axis of the antenna structures or may be oriented at a non-zero angle. Lateral and longitudinal offsets may be used in positioning the resonating element structures. Combinations of these arrangements may be used in forming antenna isolation elements.

Antennas such as antennas 56, 60, and 64 may also use these types of resonating element structures. For example, antenna 56 may be formed from two closely spaced resonating elements such as elements 156 and 160 of FIG. 16, provided that these elements are fed using appropriate antenna feed terminals such as feed terminals 86 and 84 of FIG. 5. In this type of arrangement, one of the antenna resonating elements may be directly fed using antenna feed terminals that are connected to the resonating element arm and ground plane as shown for arm 80 of antenna 74 in FIG. 5. The other antenna resonating element may be indirectly fed through near-field electromagnetic coupling (as an example).

The foregoing is merely illustrative of the principles of this invention and various modifications can be made by those skilled in the art without departing from the scope and spirit of the invention.

What is claimed is:

1. Electronic device antenna structures in an electronic device, comprising:

first, second, and third resonating elements aligned along a common axis and that are each connected to a respective ground plane portion, wherein the first and second resonating elements are fed using respective antenna feed terminals and form respective first and second antennas and wherein the third resonating element is not fed by any antenna feed terminals.

2. The electronic device defined in claim 1 wherein the first resonating element comprises a multi-band resonating element operable in at least first and second frequency bands.

3. The electronic device defined in claim 1 wherein the first resonating element comprises a multi-band inverted-F resonating element having a first arm operable in a first frequency band and having a second arm operable in a second frequency band.

4. The electronic device defined in claim 1 wherein the third resonating element comprises at least a first arm that resonates in a first frequency and a second arm that resonates in a second frequency.

5. The electronic device defined in claim 1 wherein the electronic device comprises a portable electronic device.

6. The electronic device antenna structures defined in claim 1 further comprising:

a first transmission line having a first positive conductor coupled to the antenna feed terminal of the first resonating element and a first ground conductor coupled to the ground plane portion associated with the first resonating element; and a second transmission line having a second positive conductor coupled to the antenna feed terminal of the second resonating element and a second ground conductor coupled to the ground plane portion associated with the second resonating element.

7. An electronic device, comprising:

first, second, and third resonating elements that are parallel to a common axis, wherein the first and second resonating elements are fed using respective antenna feed terminals and form respective first and second antennas and wherein the third resonating element is not fed by any antenna feed terminals;

a first transmission line having a first positive conductor coupled to the antenna feed terminal of the first resonating element and a first ground conductor; and a second transmission line having a second positive conductor coupled to the antenna feed terminal of the second resonating element and a second ground conductor.

8. The electronic device defined in claim 7 wherein the first resonating element comprises a multi-band resonating element operable in at least first and second frequency bands.

9. The electronic device defined in claim 7 wherein the first resonating element comprises a multi-band inverted-F resonating element having a first arm operable in a first frequency band and having a second arm operable in a second frequency band.

10. The electronic device defined in claim 7 wherein the third resonating element comprises at least a first arm that resonates in a first frequency and a second arm that is longer than the first arm and that resonates in a second frequency.

11. The electronic device defined in claim 7 wherein the electronic device comprises a portable electronic device.

12. The electronic device defined in claim 7 further comprising conductive housing structures that are coupled to the first and second ground conductors.

13. An electronic device, comprising:

first, second, and third resonating elements that are parallel to a common axis, wherein the first and second resonating elements are fed using respective antenna feed terminals and form respective first and second antennas and wherein the third resonating element is not fed by any antenna feed terminals;

conductive housing structures that form at least part of a ground element for the first, second, and third resonating elements;

a first transmission line having a first positive conductor coupled to the antenna feed terminal of the first resonating element and a first ground conductor coupled to the conductive housing structures; and a second transmission line having a second positive conductor coupled to the antenna feed terminal of the second resonating element and a second ground conductor coupled to the conductive housing structures.

14. The electronic device defined in claim 13 wherein the first resonating element comprises a multi-band resonating element operable in at least first and second frequency bands.

15. The electronic device defined in claim 13 wherein the first resonating element comprises a multi-band inverted-F resonating element having a first arm operable in a first frequency band and having a second arm operable in a second frequency band.

16. The electronic device defined in claim 13 wherein the third resonating element comprises at least a first arm that resonates in a first frequency and a second arm that is longer than the first arm and that resonates in a second frequency.

17. The electronic device defined in claim 13 wherein the electronic device comprises a portable electronic device.

18. The electronic device defined in claim 13 wherein the first resonating element comprises a multi-band inverted-F resonating element having a first arm operable in a first frequency band and having a second arm operable in a second frequency band and wherein the first arm of the multi-band inverted-F resonating element is longer than the second arm of the multi-band inverted-F resonating element.

19. The electronic device defined in claim 18 wherein the third resonating element comprises at least a first arm that resonates in a first frequency and a second arm that resonates in a second frequency and wherein the first arm of the third resonating element is longer than the second arm of the third resonating element.

* * * * *